US010062504B2

(12) United States Patent
Haga et al.

(10) Patent No.: US 10,062,504 B2
(45) Date of Patent: Aug. 28, 2018

(54) MANUFACTURING METHOD OF RARE-EARTH MAGNET

(71) Applicant: TOYOTA JIDOSHA KABUSHIKI KAISHA, Toyota-shi, Aichi-ken (JP)

(72) Inventors: Kazuaki Haga, Toyota (JP); Noriyuki Ueno, Toyota (JP); Akira Kano, Toyota (JP); Tomonori Inuzuka, Toyota (JP); Noritsugu Sakuma, Mishima (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 376 days.

(21) Appl. No.: 14/833,548

(22) Filed: Aug. 24, 2015

(65) Prior Publication Data

US 2016/0055969 A1 Feb. 25, 2016

(30) Foreign Application Priority Data

Aug. 25, 2014 (JP) ..... 2014-170809

(51) Int. Cl.

| | |
|---|---|
| ***H01F 41/02*** | (2006.01) |
| ***B22F 3/12*** | (2006.01) |
| ***B22F 3/24*** | (2006.01) |
| ***H01F 1/053*** | (2006.01) |
| ***B22F 3/17*** | (2006.01) |
| ***H01F 1/08*** | (2006.01) |

(52) U.S. Cl.

CPC ..... *H01F 41/0266* (2013.01); *B22F 3/1216* (2013.01); *B22F 3/1258* (2013.01); *B22F 3/17* (2013.01); *B22F 3/24* (2013.01); *H01F 1/0536* (2013.01); *H01F 1/086* (2013.01); *B22F 2998/10* (2013.01); *B22F 2999/00* (2013.01)

(58) Field of Classification Search

CPC ..... H01F 41/02

See application file for complete search history.

(56) References Cited

U.S. PATENT DOCUMENTS

| | | | | |
|---|---|---|---|---|
| 4,057,514 | A * | 11/1977 | Huschka | C04B 35/532 252/502 |
| 5,414,927 | A * | 5/1995 | Fiel | C04B 35/52 29/611 |
| 2006/0174976 | A1* | 8/2006 | Mori | B22F 3/1208 148/105 |

(Continued)

FOREIGN PATENT DOCUMENTS

| | | | |
|---|---|---|---|
| CN | 103894607 | A | 7/2014 |
| JP | 6479305 | A | 3/1989 |
| JP | 01-171204 | A | 7/1989 |

(Continued)

*Primary Examiner* — Colleen P Dunn
*Assistant Examiner* — Rajinder S Bajwa
(74) *Attorney, Agent, or Firm* — Sughrue Mion, PLLC

(57) ABSTRACT

A manufacturing method of a rare-earth magnet includes: manufacturing a first sealing body by filling a graphite container with a magnetic powder to be a rare-earth magnet material and by sealing the graphite container; manufacturing a sintered body by sintering the first sealing body to manufacture a second sealing body in which the sintered body is accommodated; and manufacturing a rare-earth magnet by performing hot plastic working on the second sealing body to give magnetic anisotropy to the sintered body.

4 Claims, 15 Drawing Sheets

(56) References Cited

U.S. PATENT DOCUMENTS

2011/0070118 A1* 3/2011 Sagawa ..... B22F 3/087
419/30

FOREIGN PATENT DOCUMENTS

| | | | | |
|---|---|---|---|---|
| JP | 01-248503 | A | | 10/1989 |
| JP | 04-044301 | A | | 2/1992 |
| JP | 06-346102 | A | | 12/1994 |
| JP | 09-129465 | A | | 5/1997 |
| JP | 2005-232473 | A | | 9/2005 |
| JP | 2013138127 | A | * | 7/2013 |
| JP | 2013138127 | A | | 7/2013 |
| KR | 1020100043086 | A | | 4/2010 |

* cited by examiner

MANUFACTURING METHOD OF RARE-EARTH MAGNET

INCORPORATION BY REFERENCE

The disclosure of Japanese Patent Application No. 2014-170809 filed on Aug. 25, 2014 including the specification, drawings and abstract is incorporated herein by reference in its entirety.

BACKGROUND OF THE INVENTION

1. Field of the Invention

The present invention relates to a manufacturing method of a rare-earth magnet.

2. Description of Related Art

A rare-earth magnet using a rare earth element such as lanthanoid is also called a permanent magnet. The rare-earth magnet using a rare earth element such as lanthanoid is used in a driving motor of a hybrid vehicle, an electric vehicle, and the like, as well as a hard disk and a motor constituting a magnetic resonance imaging device (an MRI device).

In regard to an increase in heat generation amount due to downsizing and high current density of a motor, a demand of heat resistance is more increased relative to the rare-earth magnet to be used. Because of this, how magnetic characteristics of a magnet can be maintained under high-temperature use is one of important research themes in this technical field.

As the rare-earth magnet, general sintered magnets in which crystal grains (a main phase) constituting its structure have a scale of around 3 to 5 μm, and nanocrystalline magnets configured such that crystal grains are fabricated in a nanoscale of around 50 nm to 300 nm have been known. Among the nanocrystalline magnets, a nanocrystalline magnet achieving the above nanofabrication of crystal grains while reducing an additive amount of expensive heavy rare-earth elements and a nanocrystalline magnet using no heavy rare-earth elements are currently attracting attention.

As one example of a manufacturing method of a rare-earth magnet, there has been known such a method that a sintered body is formed by performing pressure molding on a fine powder (magnetic powder) that is obtained by rapidly solidifying Nd—Fe—B molten metal, and hot plastic working is performed to give magnetic anisotropy to the sintered body, thereby manufacturing a rare-earth magnet (oriented magnet). Note that extrusion such as backward extrusion and forward extrusion, upsetting (forging), or the like is applied to the hot plastic working.

Generally, over the whole steps of manufacture and transfer of a magnetic powder, manufacture of a sintered body, and manufacture of a rare-earth magnet, a product to be manufactured in each of the step makes contact with oxygen included in an atmospheric air. As a result, an oxygen concentration inside a structure of the product to be manufactured increases or the product to be manufactured is oxidized, so that magnetic performance of a rare-earth magnet that is finally obtained decreases, which is well known.

As an index of the magnetic performance of the rare-earth magnet, residual magnetization (residual magnetic flux density), a coercive force, and the like are known. For example, it is known that, at the time when hot plastic working is performed, oxygen included in a magnet material breaks a main phase of Nd—Fe—B, thereby reducing a residual magnetic flux density and a coercive force. Further, it is also known that, at the time when grain boundary diffusion of modified alloy occurs to recover a coercive force after hot plastic working is performed, oxygen remaining inside the modified alloy obstructs penetration into the modified alloy. Moreover, it is known that oxygen taken in a magnet reacts with a rare-earth element in a grain boundary phase so as to form an oxide, so that grain boundary phase components effective to divide a main phase magnetically are reduced, thereby resulting in that a coercive force of the rare-earth magnet decreases.

As a technique to reduce an oxygen concentration of a rare-earth magnet, the following related art to prevent contact with oxygen in a manufacturing process of a rare-earth magnet is disclosed.

For example, Japanese Patent Application Publication No. 6-346102 (JP 6-346102 A) and Japanese Patent Application Publication No. 2005-232473 (JP 2005-232473) describe such a technique in which a magnetic powder for a rare-earth magnet is accommodated in a highly-airtight container filled with inert gas, and sintering is performed while the powder is supplied to a mold from the container.

Further, Japanese Patent Application Publication No. 1-248503 (JP 1-248503 A) describes a method for manufacturing a rear-earth magnet in such a manner that a magnetic powder for a rare-earth magnet is filled into a metal can, the can is made airtight under vacuum suction, and hot extrusion press is performed on the can that is heated.

Further, Japanese Patent Application Publication No. 1-171204 (JP 1-171204 A) describes a manufacturing method of a rare-earth magnet in which method a rare-earth magnet ingot is surrounded by a metallic material and then sealed, and hot working is performed on the metallic material thus sealed.

According to the related arts, a concentration of oxygen making contact with the magnetic powder, the sintered body, or the like in a manufacturing process of the rare-earth magnet can be reduced.

However, in the manufacturing methods described in JP 6-346102 A and JP 2005-232473 A, the magnetic powder is filled into the mold from the highly airtight container, so that workability is not good. Accordingly, it takes a long manufacturing time and a cost for the manufacture of the container is required, which may generally increase a manufacturing cost.

Further, in the manufacturing methods of JP 1-248503 A and JP 1-171204 A, hot-press is performed on the metal can or the like. However, for example, a magnetic powder for a Nd—Fe—B rare-earth magnet is a strongly oxidizing material as compared with general metals, so that the magnetic powder inside the metal can or the like is easily oxidized prior to the metal can or the like. Therefore, it is difficult to obtain a high oxidation-suppressant effect with respect to the magnetic powder.

SUMMARY OF THE INVENTION

The present invention provides a manufacturing method of a rare-earth magnet which manufacturing method can manufacture a rare-earth magnet with a low oxygen concentration.

An aspect of the present invention is a manufacturing method of a rare-earth magnet. The manufacturing method includes: manufacturing a first sealing body by filling a graphite container with a magnetic powder to be a rare-earth magnet material and by sealing the graphite container; manufacturing a sintered body by sintering the first sealing body to manufacture a second sealing body in which the sintered body is accommodated; and manufacturing a rare-earth magnet by performing hot plastic working on the second sealing body to give magnetic anisotropy to the sintered body.

According to the aspect of the present invention, the rare-earth magnet finally manufactured is taken out from the container. Thus, it is possible to restrain the magnetic powder, the sintered body, and the rare-earth magnet, which is a final product, from making contact with oxygen in the atmospheric air in a manufacturing process of the rare-earth magnet, so that oxidation thereof is restrained.

According to the aspect of the present invention, unlike the related art, it is not necessary to manufacture the rare-earth magnet under an inert-gas atmosphere in order to reduce an oxygen concentration or to prevent oxidation of the product. Accordingly, an expensive manufacture booth provided with an inert-gas controlling mechanism is unnecessary, and an accurate inert-gas atmosphere control is also unnecessary. Note that a step of manufacturing a magnetic powder from rapidly cooled ribbons is generally performed under a vacuum atmosphere. The magnetic powder manufactured by this method and to be accommodated in a graphite container is in a normal-temperature state. On that account, even when the magnetic powder is accommodated in the graphite container under an atmosphere, the magnetic powder is hardly oxidized. Meanwhile, oxidation of a magnet material clearly typically occurs when the magnet material is processed under a high-temperature atmosphere. According to the aspect of the present invention, oxidation of the sintered body and the rare-earth magnet is prevented efficiently at the time when the rare-earth magnet is manufactured in such a manner that the magnetic powder is sintered to manufacture the sintered body and hot plastic working is performed on the sintered body.

In the aspect of the present invention, the graphite container is used as a container for accommodating the magnetic powder or the like therein. Here, the "graphite container" includes a container made of squamous graphite, and a container made of spherical carbon particles. In a case where the container made of squamous graphite is used, at the time when the container is accommodated in a molding die or a die and hot press machining or the like is performed, squamae of the squamous graphite overlap with each other, so that a good lubricating property in the molding die or the die can be obtained. Accordingly, measures to separately apply lubricant to an inner wall of the molding die or the like become unnecessary.

Further, since graphite is a strongly oxidizing material as compared to a rare-earth magnet material such as Nd—Fe—B, the graphite container is oxidized prior to the rare-earth magnet material under a high-temperature atmosphere at the time of hot-press or the like. This makes it possible to restrain oxidation of the rare-earth magnet material inside the container.

The manufacturing method according to the aspect of the invention may further include manufacturing the first sealing body by inserting an open end of a first graphite container into an open end of a second graphite container after filling the magnetic powder into the first graphite container. The graphite container may be constituted by the first graphite container and the second graphite container. An inside dimension of the second graphite container may be larger than an inside dimension of the first graphite container. Each of the first graphite container and the second graphite container may be a tube-shaped body constituted by a deformed graphite sheet and having a rectangular section or a circular section. The tube-shaped body may have a closed end provided with a graphite base plate.

According to the above configuration, by inserting the open end of the first graphite container into the open end of the second graphite container, it is possible to easily shield the inside of the container from its outside.

The manufacturing method according to the aspect of the invention may further include manufacturing the first sealing body by disposing a graphite top plate on an open end of the graphite container after filling the magnetic powder into the graphite container. The graphite container may be a tube-shaped body constituted by a deformed graphite sheet and having a rectangular section or a circular section. The tube-shaped body may have a closed end provided with a graphite base plate.

In the above configuration, the graphite top plate is fitted to the open end of the graphite container. In this state, a predetermined pressure may be applied to the container from its outside so as to cause an inner surface of the container to make close contact with an end surface of the top plate. Hereby, it is possible to easily shield the inside of the container from its outside.

In the above configuration, the manufacturing method may further include manufacturing the graphite base plate by performing press molding on graphite powder filled into the tube-shaped body.

According to the above configuration, it is possible to cause the graphite base plate to make close contact with an inner surface of the tube-shaped body.

In the above configuration, the "rectangular section" includes a square or rectangular sectional shape, a shape in which corners of such a sectional shape are curved, a trapezoidal sectional shape, and a diamond-shaped sectional shape. Further, the "deformed graphite sheet" includes a graphite sheet that is curved at the time of forming a tube-shaped body having a circular section.

In the above configuration, the manufacturing method may further include manufacturing the graphite top plate by performing press molding on graphite powder.

In the above configuration, the manufacturing method may further include: forming the tube-shaped body by deforming a graphite sheet along a side surface of a tube-shaped stand, the side surface having a rectangular section or a circular section, the tube-shaped stand including a bottom face provided on an end surface of the side surface, and the bottom face having a through-hole; filling graphite powder into the tube-shaped stand by moving the tube-shaped stand relative to the tube-shaped body; and forming the base plate on an open end of the tube-shaped body by pushing the tube-shaped stand downward to perform press molding on the graphite powder after the graphite powder falls down below the bottom face of the tube-shaped stand through the through-hole.

According to the above configuration, by deforming the graphite sheet along the tube-shaped stand including the side surface having a shape corresponding to the tube-shaped body, the tube-shaped body can be manufactured efficiently.

In the above configuration, when the tube-shaped stand inside the tube-shaped body thus manufactured is moved relative to the tube-shaped body, a space is formed below the bottom face of the tube-shaped stand. The graphite powder accommodated in the tube-shaped stand falls down into the space through the through-hole of the bottom face. In this state, the tube-shaped stand is pushed downward, so that press molding is performed on the graphite powder by the bottom face of the tube-shaped stand, and thus, the base plate of the graphite container is manufactured. That is, in the above configuration, the tube-shaped stand can be used not only to deform the graphite sheet but also to press-mold the base plate.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

With reference to the drawings, the following describes a manufacturing method of a rare-earth magnet according to an embodiment of the present invention. The manufacturing method of a rare-earth magnet according to the embodiment of the present invention includes a first step, a second step, and a third step.

Figure 1:
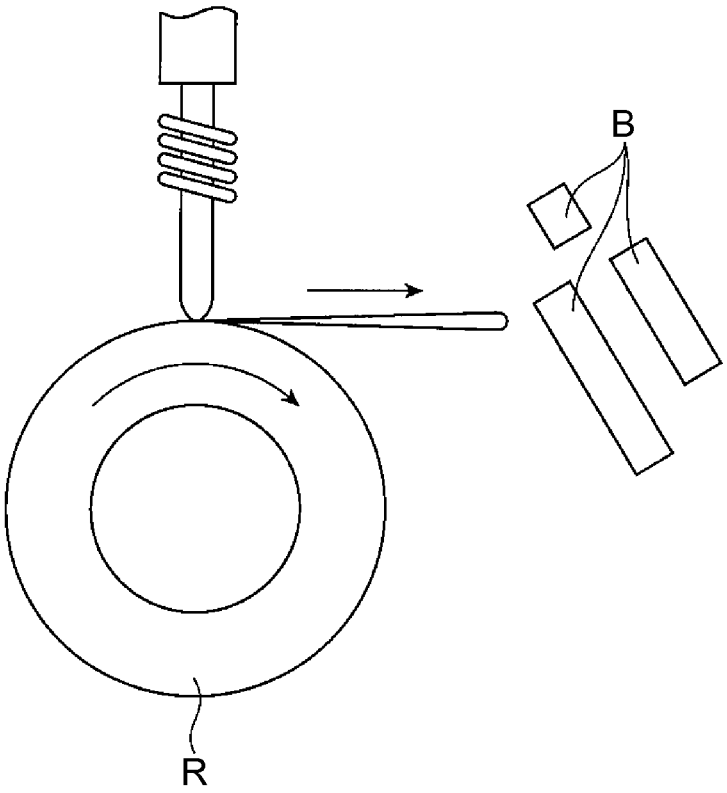
FIG. 1 is a schematic view illustrating a manufacturing method of a magnetic powder to be used in a first step of a manufacturing method of a rare-earth magnet according to an embodiment of the present invention.

FIG. 1 is a schematic view illustrating a manufacturing method of a magnetic powder to be used in the first step. In the first step, a graphite container is filled with a magnetic powder to be a rare-earth magnet material and then sealed, so as to manufacture a first sealing body. In a furnace (not shown) in which a pressure is decreased to 50 kPa or less, for example, a melt spinning method using a single roll is performed such that an alloy ingot is melted at a high frequency and molten metal having a composition that provides a rare-earth magnet is jetted to a copper roll R, so as to manufacture rapidly cooled strips B (rapidly cooled ribbons).

The rapidly cooled strips B thus manufactured are roughly crushed, so as to manufacture a magnetic powder. Here, a diameter range of the magnetic powder is adjusted to be within a range of 75 to 300 μm.

Figure 2A:
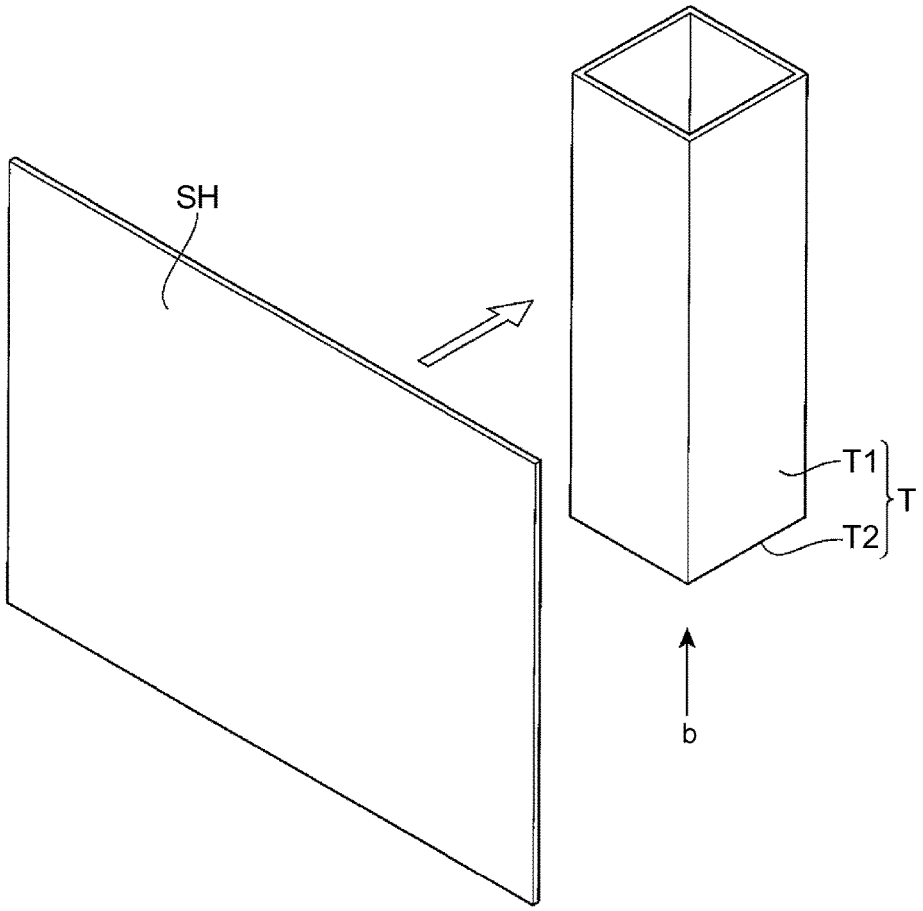
FIG. 2A is a schematic view illustrating a manufacturing step of a graphite container.
Figure 2B:
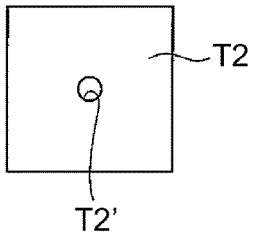
FIG. 2B is a view when viewed from a direction of an arrow b in FIG. 2A.
Figure 3:
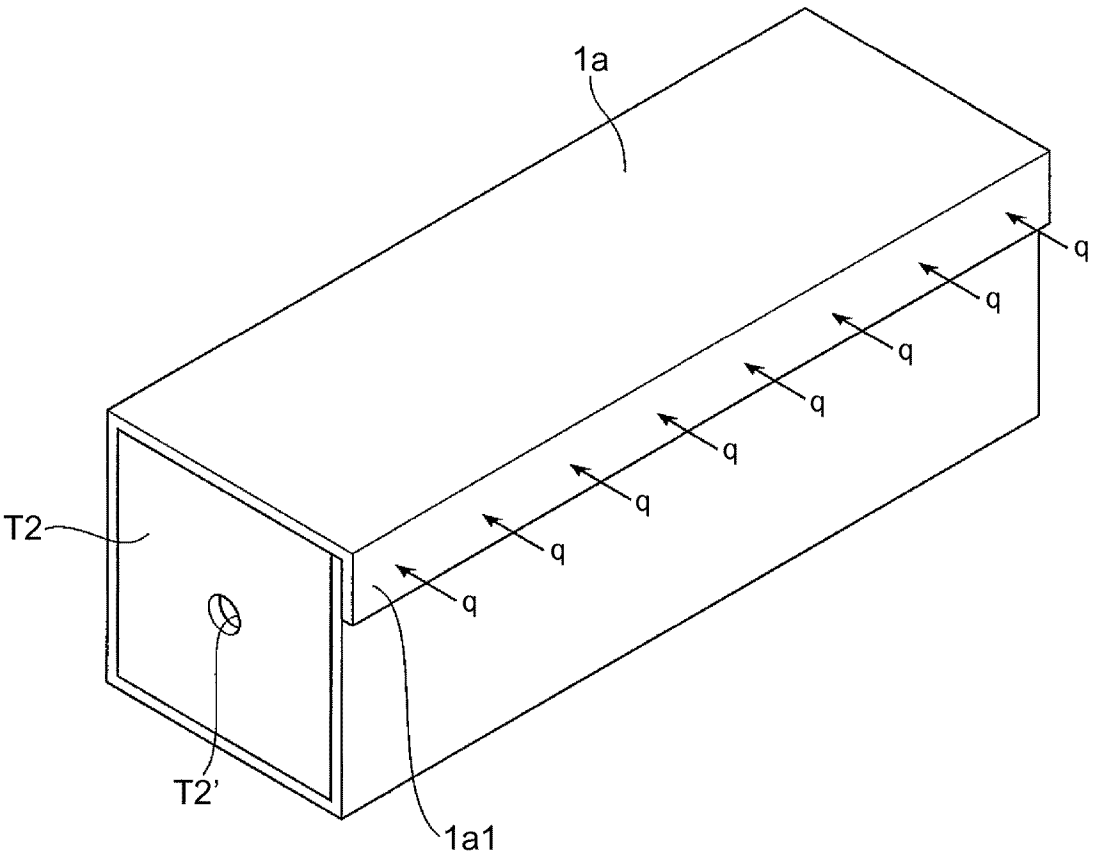
FIG. 3 is a schematic view illustrating a manufacturing step of the graphite container, following the step in FIG. 2A.

Next will be described a manufacturing method of a graphite container to be used in the first step, with reference to FIGS. 2A to 6. First, as illustrated in FIGS. 2A, 2B, a tube-shaped stand T including a side surface T1 having a rectangular section and a bottom face T2 provided on one end surface of the side surface T1 and having a through-hole T2' is prepared. By deforming a graphite sheet SH along the side surface T1 of the tube-shaped stand T, a tube-shaped body 1*a*, which is a component of a graphite container having a rectangular section as illustrated in FIG. 3, is manufactured. Note that, as illustrated in FIG. 3, an overlap margin 1a1 is pressed from its outside by an external force q of about 1 kN, so that ends of the graphite sheet SH adhere to each other.

Figure 4B:
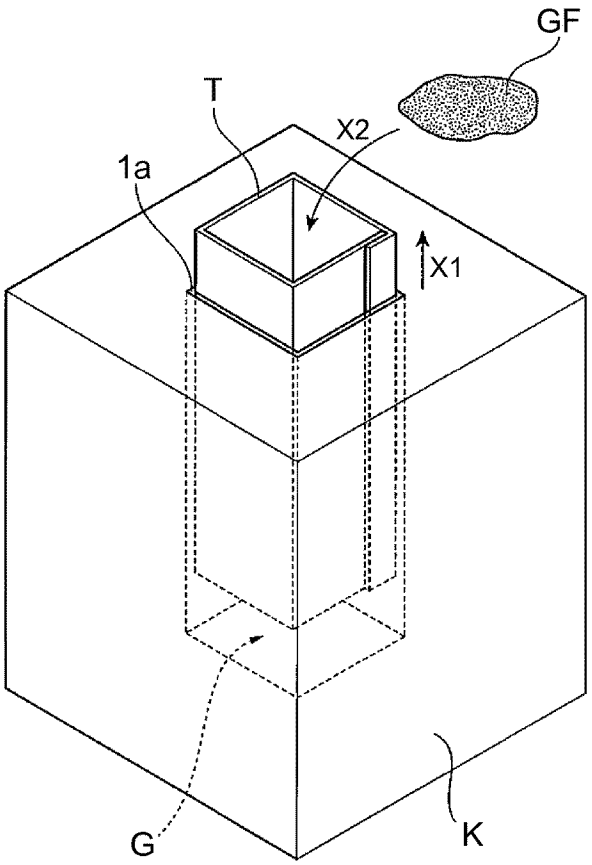
FIG. 4B is a schematic view illustrating a manufacturing step of the graphite container, following the step in FIG. 4A.
Figure 4A:
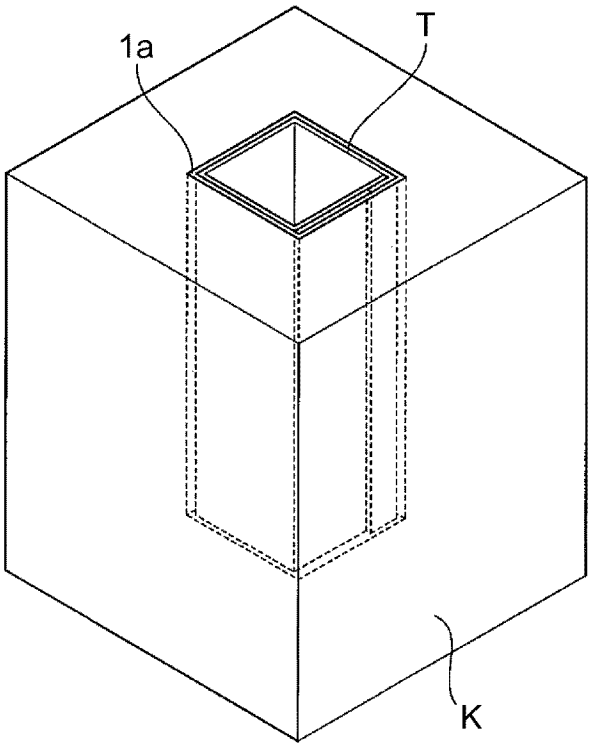
FIG. 4A is a schematic view illustrating a manufacturing step of the graphite container, following the step in FIG. 3.

The tube-shaped body la thus formed around the tube-shaped stand T and the tube-shaped stand T are accommodated in a cavity of a molding die K as illustrated in FIG. 4A.

Then, as illustrated in FIG. 4B, the tube-shaped stand T inside the tube-shaped body 1*a* is moved upward (in an X1-direction) relative to the tube-shaped body 1*a*, so as to form a space below the bottom face T2 of the tube-shaped stand T, and a graphite powder GF is filled into the tube-shaped stand T (in an X2-direction). The graphite powder GF thus filled falls down into a space formed below the bottom face T2, through the through-hole T2'of the bottom face T2 of the tube-shaped stand T.

Figure 5:
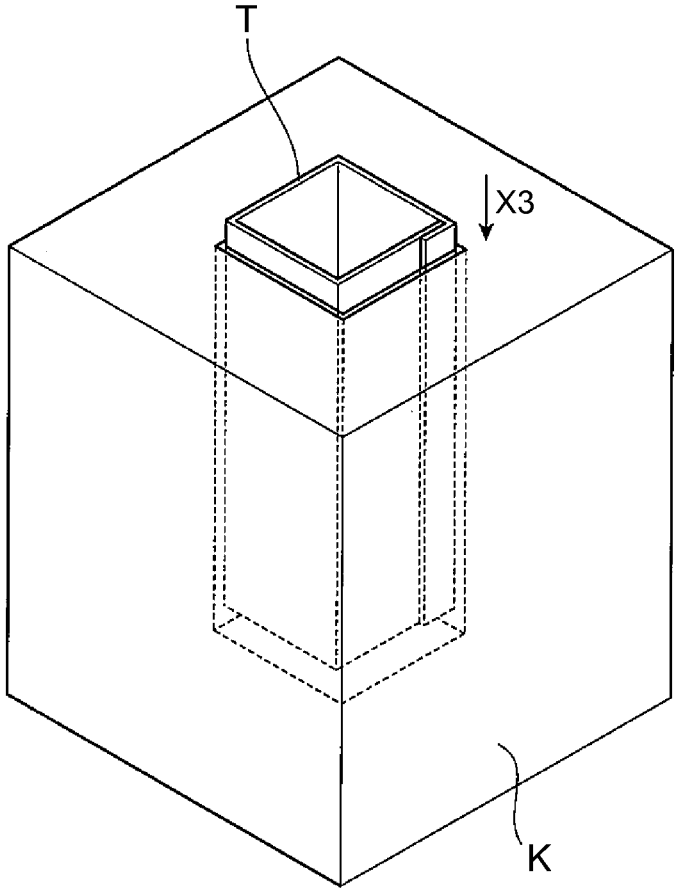
FIG. 5 is a schematic view illustrating a manufacturing step of the graphite container, following the step in FIG. 4B.
Figure 6:
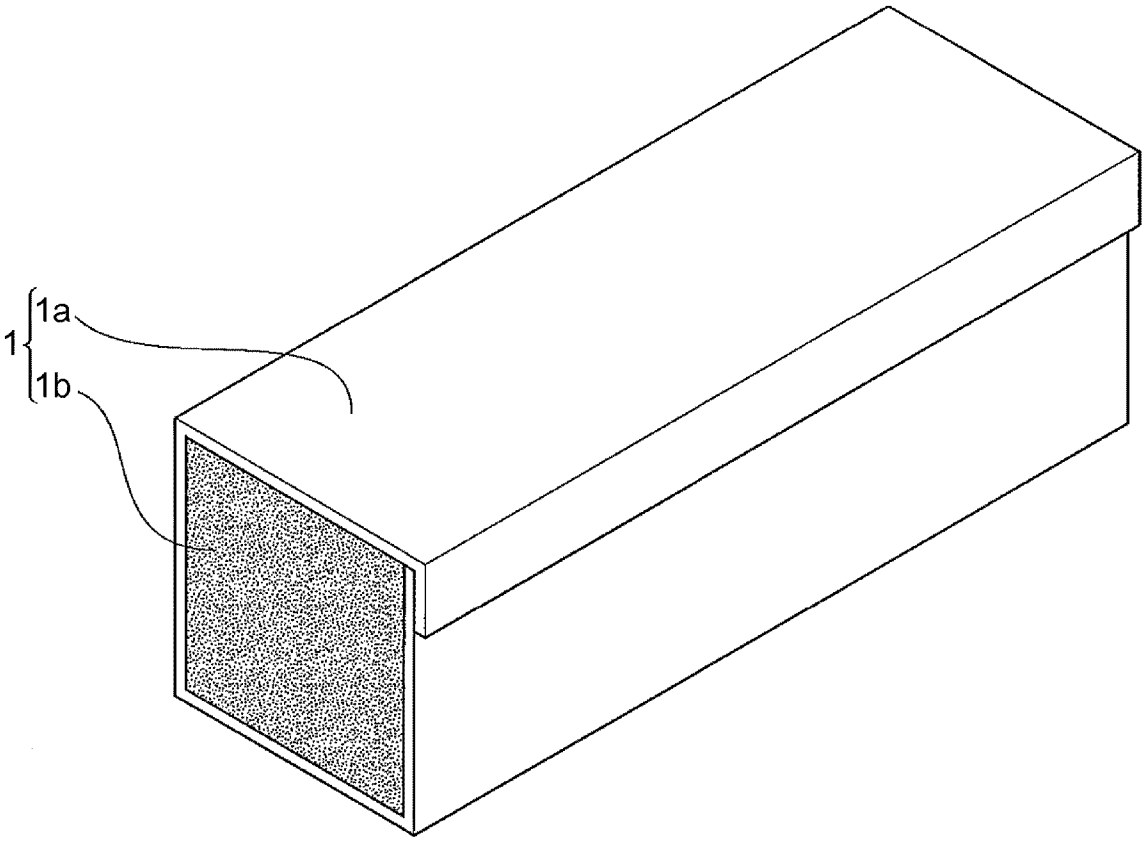
FIG. 6 is a perspective view of the graphite container manufactured in the step in FIG. 5, when viewed from its bottom side.

When a predetermined amount of the graphite powder GF falls down into the space, the tube-shaped stand T is pushed downward as illustrated in FIG. 5 so as to perform press molding (in an X3-direction). Hereby, as illustrated in FIG. 6, a graphite container 1 constituted by the tube-shaped body la and a base plate lb is manufactured. As described above, the tube-shaped body 1*a* is constituted by a deformed graphite sheet, and has a rectangular section. The base plate 1*b* is formed by performing press molding on the graphite powder GF in one open end of the tube-shaped body 1*a*. The tube-shaped body 1*a* has a closed end closed by the base plate 1*b* and an open end on the other end.

In the first step, the graphite container 1 thus manufactured is filled with a magnetic powder and sealed, so as to manufacture a first sealing body. The first sealing body may be manufactured in steps illustrated in FIGS. 7A and 7B, or in steps illustrated in FIGS. 8A, 8B. These steps are described below sequentially.

Figure 7B:
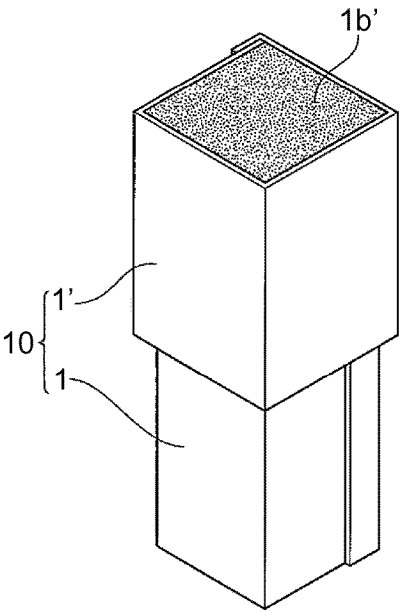
FIG. 7B is a perspective view illustrating the one example of the first sealing body manufactured in the step in FIG. 7A.
Figure 7A:
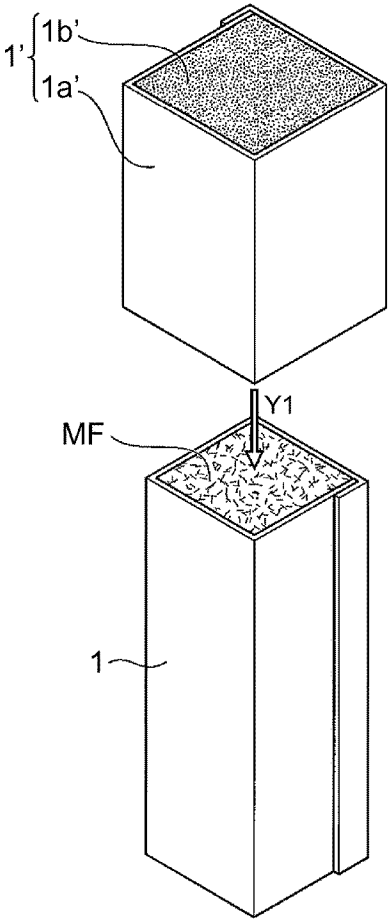
FIG. 7A is a schematic view illustrating a first step of manufacturing one example of a first sealing body, which first step is included in the manufacturing method of a rare-earth magnet according to the embodiment of the present invention.

First, in a manufacturing method of the first sealing body as illustrated in FIGS. 7A, 7B, a first graphite container 1 and a second graphite container 1' are prepared as illustrated in FIG. 7A. After the first graphite container 1 is filled with a magnetic powder MF, the first graphite container 1 is covered with an open end of the second graphite container 1' from an open end side of the first graphite container 1. In other words, the open end of the first graphite container 1 is inserted into the open end of the second graphite container F. Thus, a first sealing body 10 in which the magnetic powder is sealed by the first graphite container 1 and the second graphite container F is manufactured as illustrated in FIG. 7B.

Figure 8B:
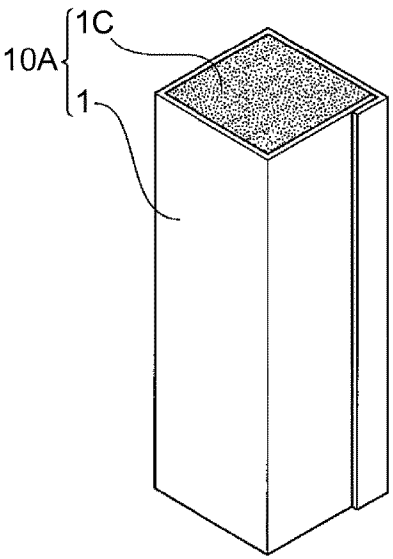
FIG. 8B is a perspective view illustrating the one example of the first sealing body manufactured in the step in FIG. 8A.
Figure 8A:
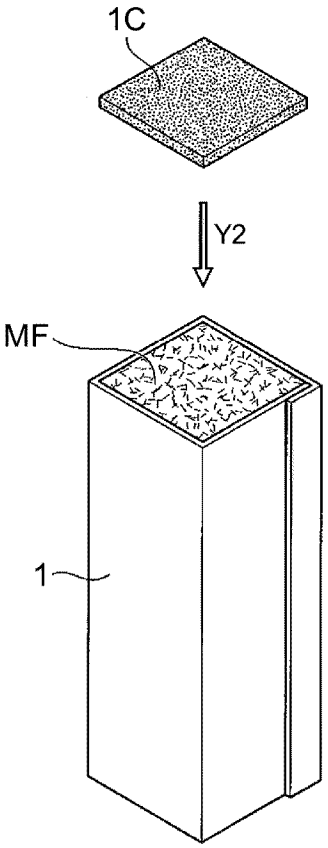
FIG. 8A is a schematic view illustrating a first step of manufacturing one example of the first sealing body, which first step is included in the manufacturing method of a rare-earth magnet according to the embodiment of the present invention.

In a manufacturing method of the first sealing body as illustrated in FIGS. 8A, 8B, a top plate 1*c* manufactured by performing press molding on a graphite powder is used as well as a graphite container 1, as illustrated in FIG. 8A. After the graphite container 1 is filled with a magnetic powder MF, the top plate 1*c* is fitted into an open end of the graphite container 1, and then, a predetermined pressure is applied to the graphite container 1 from its outside, so as to cause an inner surface of the graphite container 1 to make close contact with an end surface of the top plate 1*c*. Thus, a first sealing body 10A in which the magnetic powder is sealed is manufactured.

After the first sealing body 10 or the first sealing body 10A is manufactured by a method of either the steps of FIGS. 7A, 7B or the steps of FIGS. 8A, 8B, manufacturing of a sintered body, which is the second step, is performed. Herein, the following description is made with reference to the first sealing body 10.

Figure 9:
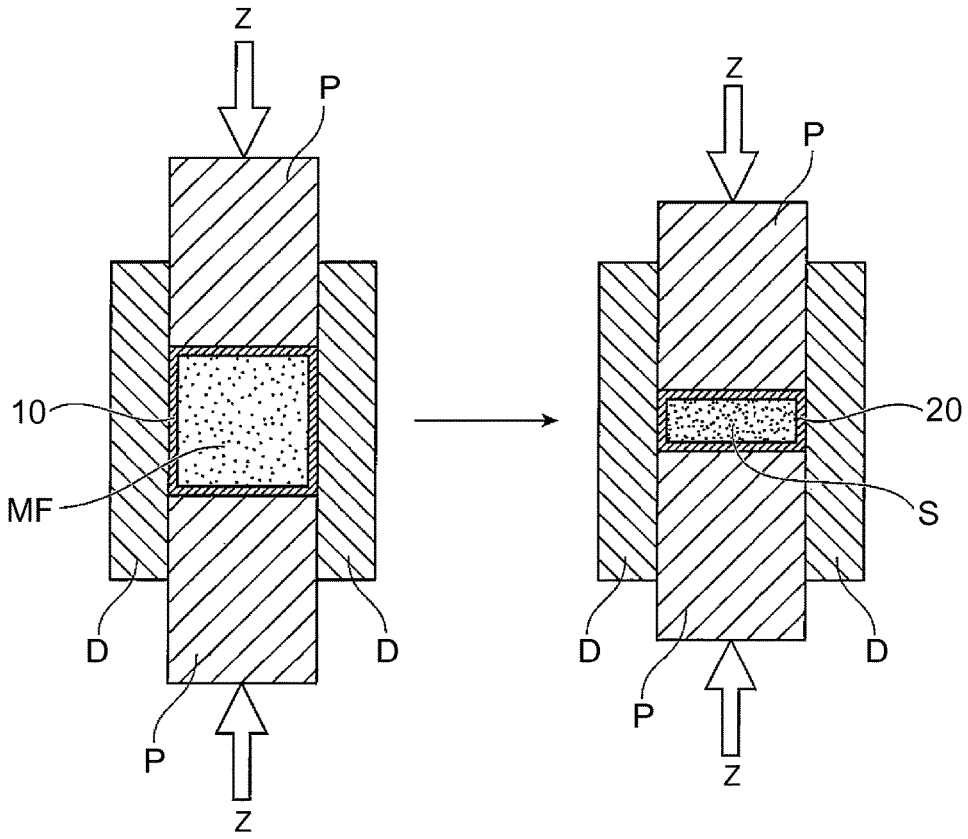
FIG. 9 is a schematic view illustrating a second step of the manufacturing method of a rare-earth magnet according to the embodiment of the present invention.

FIG. 9 is a schematic view illustrating the second step of the manufacturing method. As illustrated in FIG. 9, the first sealing body 10 is accommodated in a cavity defined by a cemented carbide die D and a cemented punch P sliding in a hollow of the cemented carbide die D. Then, while a pressure is increased by the cemented punch P (in a Z-direction), a current is flowed in a pressure direction so as to perform heating by current application at around 800° C. Hereby, a sintered body S accommodated in a second sealing body 20 obtained by crushing the first sealing body 10 is manufactured (the second step). The sintered body S includes, for example, a main phase of Nd—Fe—B of a nanocrystal structure (with an average particle diameter of 300 nm or less, e.g., a grain size of around 50 nm to 200 nm), and a grain boundary phase of Nd—X alloy (X: metal element) provided around the main phase.

The Nd-X alloy constituting the grain boundary phase of the sintered body S is made of Nd and at least one type of alloy selected from Co, Fe, Ga, and the like. The Nd—X alloy is at least one of Nd—Co, Nd—Fe, Nd—Ga, Nd—Co—Fe, and Nd—Co—Fe—Ga, or two or more thereof in combination, and includes Nd relatively abundantly.

Figure 10:
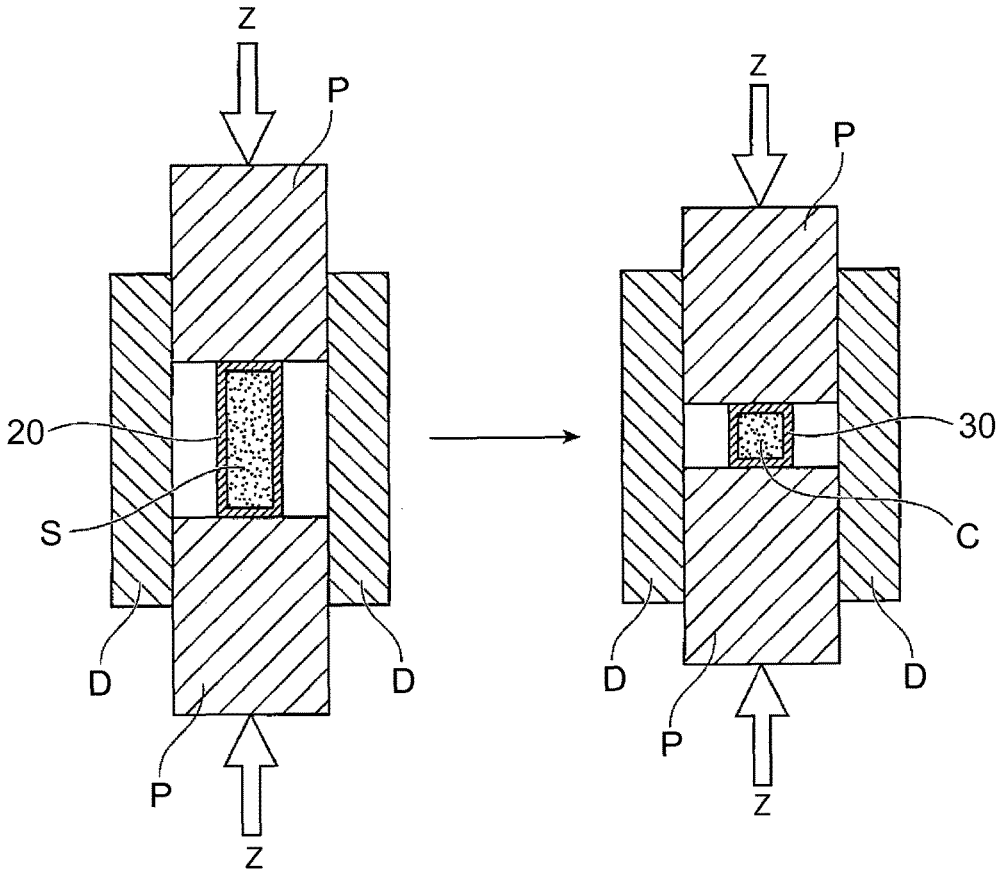
FIG. 10 is a schematic view illustrating a third step of the manufacturing method of a rare-earth magnet according to the embodiment of the present invention.

The second sealing body 20 accommodating therein the sintered body S manufactured in the second step is accommodated again in the cavity defined by the cemented carbide die D and the cemented punch P, as illustrated in FIG. 10. Then, hot plastic working is performed while a pressure is increased by the cemented punch P (in the Z-direction). Hereby, a rear-earth magnet C (oriented magnet) accommodated in a third sealing body 30 obtained by crushing the second sealing body 20 is manufactured (the third step). Magnetic anisotropy is given to the sintered body S by the third step. Note that a strain rate at the time of the hot plastic working is preferably adjusted to be 0.1/sec or more. Further, in a case where a machining ratio (compressibility) due to the hot plastic working is large, for example, in a case where the compressibility is around 10% or more, the hot plastic working can be called strong processing, but the hot plastic working is preferably performed at a processing rate of around 60 to 80%.

Figure 11A:
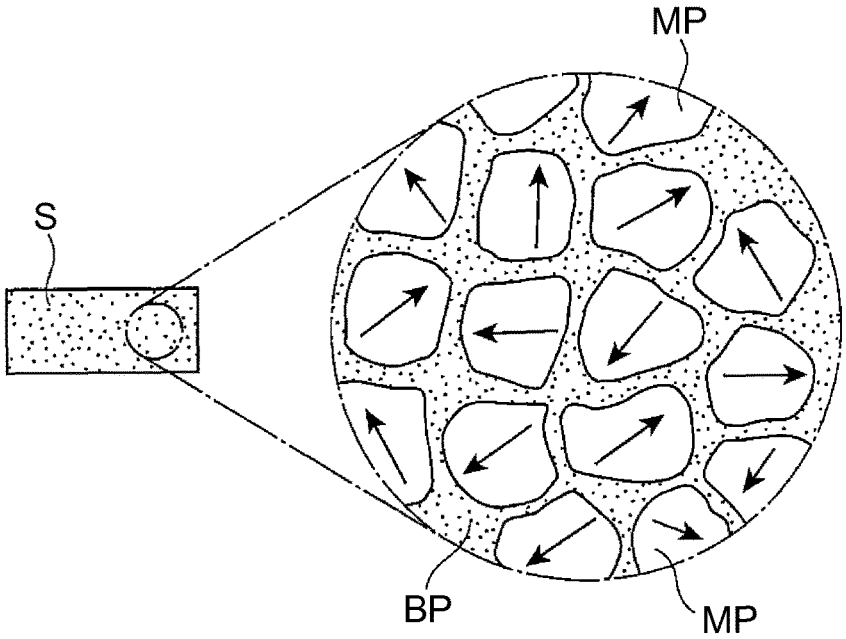
FIG. 11A is a view illustrating a microstructure of a sintered body illustrated in FIG. 9.
Figure 11B:
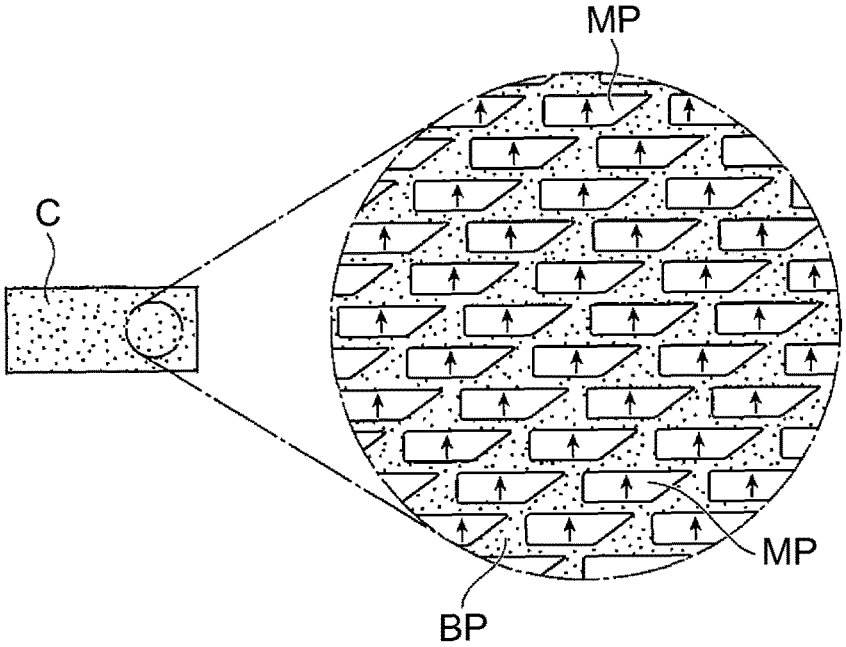
FIG. 11B is a view illustrating a microstructure of a rare-earth magnet illustrated in FIG. 10.

As illustrated in FIG. 11A, the sintered body S manufactured in the second step exhibits an isotropic crystal structure in which the grain boundary phase BP is filled between nanocrystal grains MP (the main phase). In contrast, as illustrated in FIG. 11B, the rare-earth magnet C manufactured in the third step exhibits a magnetically anisotropic crystal structure.

According to the manufacturing method of the rare-earth magnet of the present invention, the first sealing body 10 is manufactured by accommodating the magnetic powder MF in the graphite container 1; the sintered body S is manufactured by performing hot press working on the first sealing body 10; and the rare-earth magnet is manufactured (in a state of the third sealing body 30) such that hot plastic working is performed in a state (a state of the second sealing body 20) where the sintered body S is accommodated in the graphite container 1. Accordingly, in the manufacturing process of the rare-earth magnet, the magnetic powder MF, the sintered body S in a high temperature state, and the rare-earth magnet C in a high temperature state are shielded from the atmospheric air efficiently. Further, the graphite container 1 is a strongly oxidizing material as compared to the rare-earth magnet material, and oxidizes prior to the rare-earth magnet material. Because of this, the rare-earth magnet C with a low oxygen concentration can be manufactured without the need of manufacture under an inert gas atmosphere. Further, graphite forming the graphite container 1 has a good lubrication action inside the cemented carbide die D, so that application of lubricant to the cemented carbide die D is unnecessary, thereby achieving excellent manufacture efficiency.

The inventors of the present invention carried out an experiment to specify a relationship between with or without a graphite container and an oxygen concentration inside a manufactured rare-earth magnet, and an experiment to specify a relationship between with or without a graphite container and a coercive force inside a manufactured rare-earth magnet, in the following manner.

A test specimen in Example 1 is described below. Predetermined amounts of rare-earth magnet materials (an alloy composition is 29.8 Nd-0.2 Pr-4 Co-0.9 B-0.6 Ga-Bal.Fe (mass %)) were blended and then melted under an Ar-gas atmosphere. After that, resultant molten metal was ejected from an orifice to a rotating roller, which is made of Cu and plated with Cr, and then cooled down rapidly, so as to manufacture rapidly cooled strips. The rapidly cooled strips were then crushed so as to obtain a magnetic powder. Then, 30 g of the magnetic powder was accommodated in a container (a graphite container) manufactured by a graphite sheet of 7.2×28.2×60 mm, and a pressure was applied to a top face so as to be sealed. The container was placed in a cemented carbide die heated to 650° C. under the atmospheric air, and then subjected to press burning at a load of 400 MPa. After a sintered body was manufactured by press burning, the sintered body was maintained for 60 seconds, and then taken out from the die. A height of the sintered body was 20 mm. The sintered body was then accommodated in a forging die prepared separately, and hot plastic working was performed at a heating temperature of 750° C., a processing rate of 75%, and a strain rate of 1.0/sec, so as to manufacture a rare-earth magnet. A test specimen with a size of 4.0×4.0×2.0 mm was cut out from the rare-earth magnet thus manufactured, and magnetic characteristics thereof were evaluated.

In comparison with the test specimen of Example 1, a test specimen of Comparative Example 1 was manufactured without using a graphite sheet in a manufacturing process thereof, and the other manufacturing conditions and the like are the same as in Example 1.

Figure 12A:
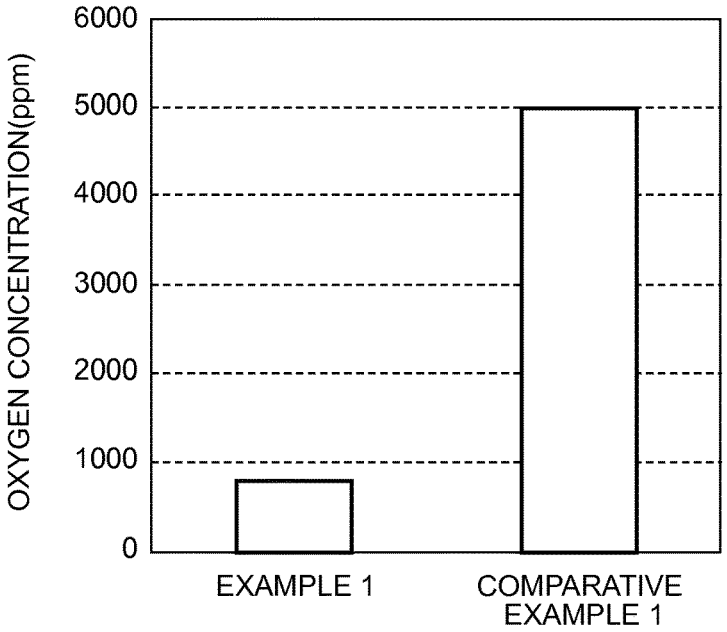
FIG. 12A is a view illustrating an experimental result related to a relationship between with or without a graphite container and an oxygen concentration inside a manufactured rare-earth magnet.
Figure 12B:
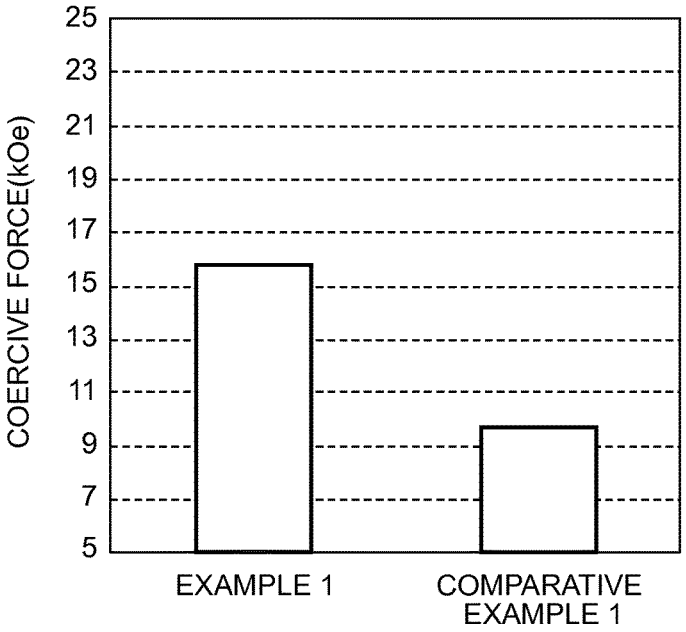
FIG. 12B is a view illustrating an experimental result related to a relationship between with or without a graphite container and a coercive force inside a manufactured rare-earth magnet.

Respective oxygen concentrations of the test specimens were measured by use of an oxygen analyzer, and respective coercive forces of the test specimens were measured by use of a vibrating sample magnetometer (VSM). FIG. 12A is a view illustrating an experimental result related to the oxygen concentrations inside the rare-earth magnets. FIG. 12B is a view illustrating an experimental result related to the coercive forces inside the rare-earth magnets.

From FIG. 12A, it is demonstrated that Example 1 manufactured by use of a graphite container had an oxygen concentration of 1000 ppm or less, Comparative Example 1 manufactured without using a graphite container had an oxygen concentration of around 5000 ppm, and thus, Example 1 can reduce the oxygen concentration by 20% or less relative to Comparative Example 1.

Further, from FIG. 12B, it is demonstrated that the coercive force of Comparative Example 1 was 10 kOe or less, whereas the coercive force of Example 1 was 16 kOe, and thus, the coercive force of Example 1 is higher than that of Comparative Example 1 by about 60%.

This can be described from a relationship between the oxygen concentration and the coercive force of the rare-earth magnet. That is, in Example 1 manufactured by use of a graphite container, the container prevents the magnetic powder from making contact with the atmospheric air, so that oxidation of the sintered body does not proceed, thereby making it possible to attain an expected high coercive force. In contrast, in Comparative Example 1 manufactured without using a graphite container, the magnetic powder and the sintered body make contact with the atmospheric air in a normal-temperature transfer process and a high-temperature forming process, so that oxidation thereof proceeds. As a result, an oxide is formed due to a reaction between oxygen and a rear-earth element in a grain boundary phase that has a large effect to coercive force performance, so that a percentage of the grain boundary phase contributing to the coercive force decreases and a percentage of the grain boundary phase magnetically dividing the main phase decreases, thereby presumably decreasing the coercive force.

The inventors of the present invention carried out an experiment to specify a relationship between an oxygen concentration of an outside atmosphere at the time of manufacturing a sintered body and an oxygen concentration inside the sintered body thus manufactured, in a case where a graphite container is used. Note that Example 1 in this experiment is the same as Example 1 in the previously explained experiment.

An outside oxygen concentration in a manufacturing process of Example 1 was 20% (the atmospheric air). Outside oxygen concentrations in a manufacturing process of Reference Example 1 were set to 0.01%, 1.0%, 3.0%, 5.0%. The other manufacturing conditions and the like are the same as in Example 1.

Figure 13:
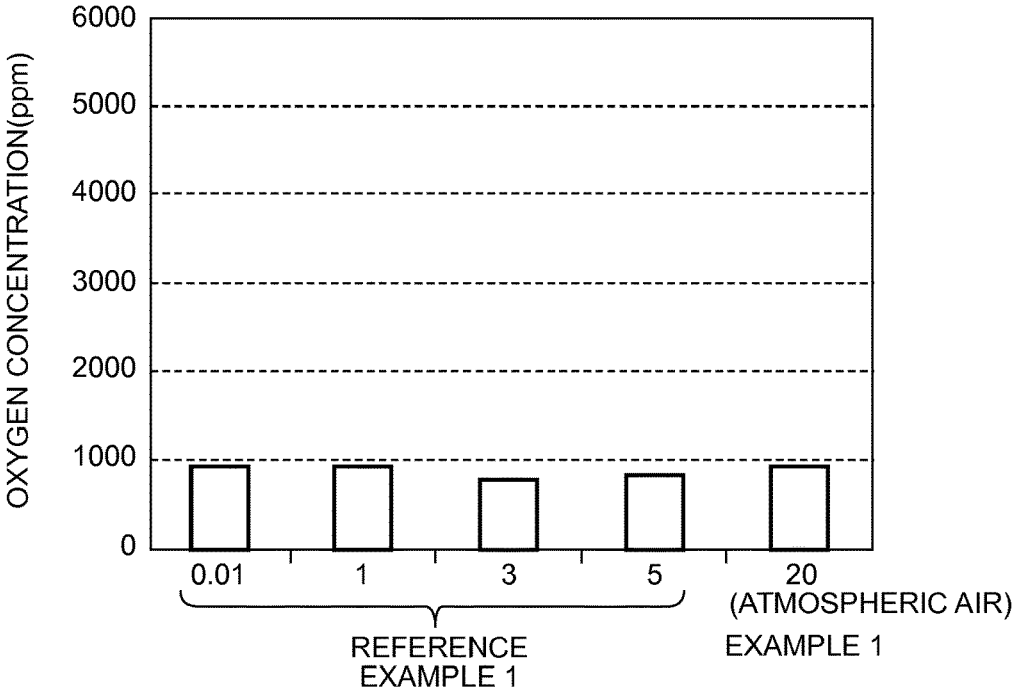
FIG. 13 is a view illustrating an experimental result related to a relationship between an oxygen concentration of an outside atmosphere at the time of manufacturing a sintered body and an oxygen concentration inside the sintered body thus manufactured, in a case where a graphite container is used.

An experimental result is shown in FIG. 13. According to FIG. 13, even if the outside oxygen concentrations were reduced, respective oxygen concentrations inside manufactured rare-earth magnets were 1000 ppm, which is not different from Example 1. As a result, it was found that, in a process of manufacturing a rare-earth magnet by use of a graphite container, it is not necessary to reduce the outside oxygen concentration, and even if the manufacturing was performed under the atmospheric air, a rare-earth magnet with a low internal oxygen concentration can be manufactured.

The inventors of the present invention carried out an experiment to specify a relationship between a press burning temperature at the time of manufacturing a sintered body and an oxygen concentration inside the sintered body thus manufactured, in a case where a graphite container is used. Note that Example 1 in this experiment is the same as Example 1 in the previously explained experiment.

A temperature at the time of press burning in a manufacturing process of Example 1 was 650° C. Temperatures at the time of press burning in a manufacturing process of Reference Example 2 were set to 700° C., 750° C. The other manufacturing conditions and the like are the same as in Example 1.

Figure 14:
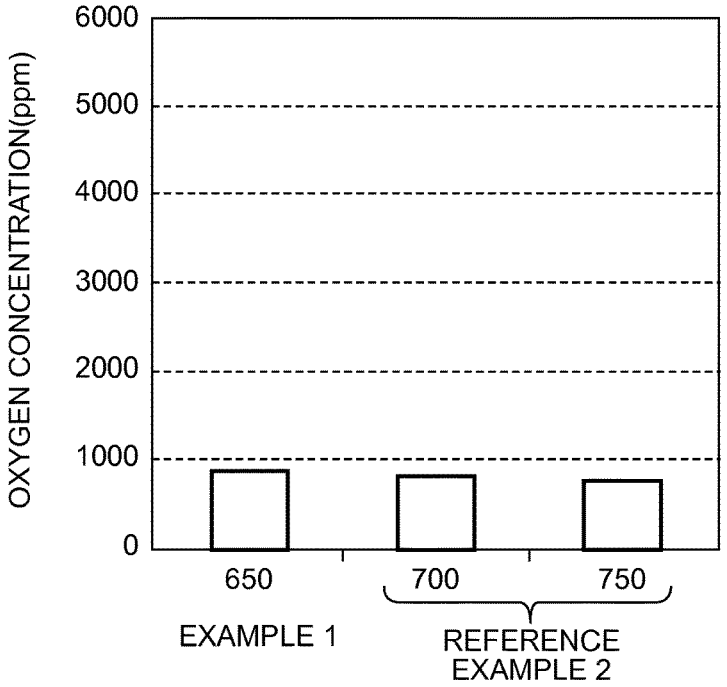
FIG. 14 is a view illustrating an experimental result related to a relationship between a press burning temperature at the time of manufacturing a sintered body and an oxygen concentration inside the sintered body thus manufactured, in a case where a graphite container is used.

An experimental result is shown in FIG. 14. From FIG. 14, even if the press burning temperatures were increased, respective oxygen concentrations of rare-earth magnets were 1000 ppm or less, which is not different from Example 1. One conceivable reason thereof is as follows: an oxidation temperature of graphite used in the container exceeds 800° C., and even if the container is exposed to high temperatures below this temperature, the container is not consumed to cause CO or $CO_2$. Thus, airtightness can be maintained.

The inventors of the present invention further carried out an experiment related to usability and high-temperature wet performance, an experiment related to heating duration, and an experiment related to an oxygen concentration inside a rear-earth magnet, each in the following cases: a case where a rare-earth magnet is manufactured by use of a graphite container made of a graphite sheet; and a case where a rare-earth magnet is manufactured by applying, as lubricant, graphite particles or material particles other than the graphite particles to a molding die.

With the use of a graphite sheet having a thickness of 60 μm, a graphite container illustrated in FIG. 6 was manufactured by employing the manufacturing method illustrated in FIGS. 2A to 5. In the graphite container, a magnetic powder having an average grain size of 150 nm with a magnitude of 45 to 300 μm was accommodated. The graphite container was then accommodated in a molding die, and hot-press was performed so as to manufacture a sintered body. The sintered body was then subjected to hot plastic working, so as to manufacture a test specimen (a rectangular solid having a dimension of 30×10×18 mm) of Example 2 of the rare-earth magnet.

A sintered body manufactured by performing hot-press on the same magnetic powder as in Example 2 was immersed into glass lubricant. Then, the sintered body was taken out and accommodated in a molding die, and subjected to hot forming under an Ar-gas atmosphere (with an oxygen concentration of 1000 ppm or less), so as to manufacture a test specimen of Comparative Example 2.

A sintered body obtained by performing hot-press on the same magnetic powder as Example 2 was immersed in graphite lubricant. Then, the sintered body was taken out and accommodated in a molding die, and subjected to hot forming under an Ar-gas atmosphere (with an oxygen concentration of 1000 ppm or less), so as to manufacture a test specimen of Comparative Example 3.

A sintered body obtained by performing hot-press on the same magnetic powder as Example 2 was immersed in glass lubricant. Then, the sintered body was taken out and accommodated in a molding die, and subjected to hot forming under the atmospheric air, so as to manufacture a test specimen of Comparative Example 4.

High-temperature wet performance was evaluated in a ring compression test. Here, the ring compression test is performed such that, with the use of a compression apparatus using a vertical 1000-ton hydraulic press that can freely adjust a rolling speed from 1.0 to 7.8 mm/sec, a ring-shaped test piece is sandwiched between upper and lower anvils to which lubricant is applied and a compression test is performed.

By the compression test, a high-temperature friction coefficient as an evaluation index of high-temperature wettability was calculated as for Example 2 and Comparative Examples 2, 3.

In the meantime, in terms of Example 2 and Comparative Examples 2, 3, qualitative evaluation on usability of each lubricant was also performed. Here, the "usability" indicates both continuous productivity and maintainability. The continuous productivity is an index indicative of whether or not manufacture is stopped (the facility is stopped) because a solidified substance of lubricant is attached to a molding die or the like and remains or attached to the facility at the time when the lubricant is used and applied to the molding die or a compact to be formed. When a removal operation is performed frequently, "the continuous productivity is low." In the meantime, in terms of the "maintainability," in a case where a deposition amount of lubricant or the like is small and a removal time is not required at the time when a molding die is fixed or a general maintenance action is performed in facility check, "the maintainability is high."

Further, as a heating test, high-frequency induction heating is applied to Example 2, heating in a molding die is applied to Comparative Examples 2 to 4, and a heating duration before a material temperature reaches 700° C. was measured by a noncontact thermometer.

Further, respective test specimens of Example 2 and Comparative Examples 3, 4, were rapidly heated to 2700° C., and respective oxygen concentrations in generated gas were measured by use of an oxygen amount/nitrogen amount measuring device.

Figure 15:
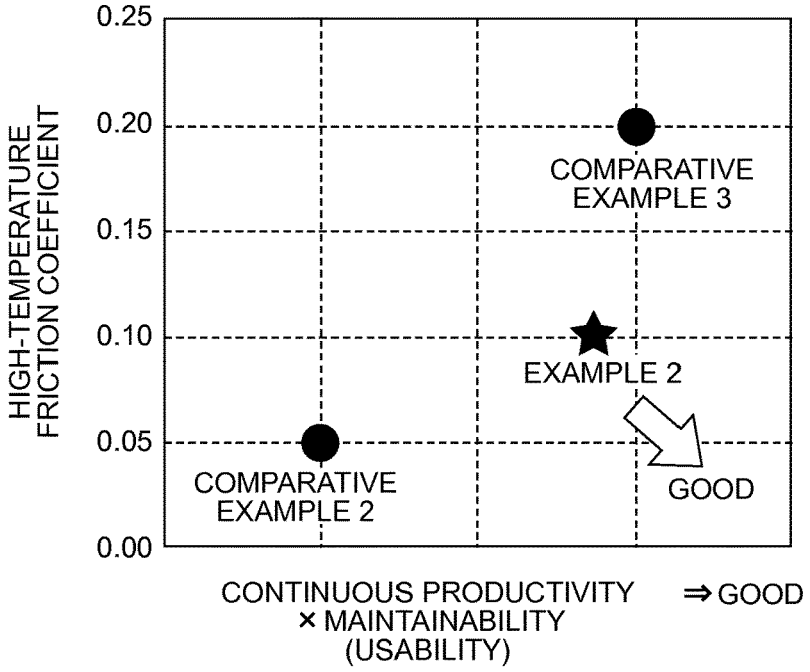
FIG. 15 is a view illustrating an experimental result related to usability and high-temperature friction coefficient in the following cases: a case where a rare-earth magnet is manufactured by use of a graphite container made of a graphite sheet; and a case where a rare-earth magnet is manufactured by applying, as lubricant, graphite particles or material particles other than the graphite particles to a molding die.
Figure 16:
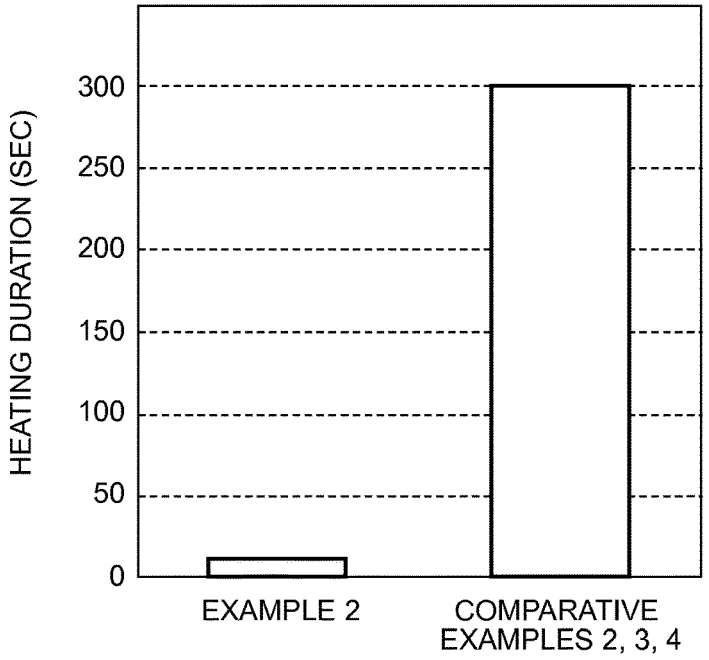
FIG. 16 is a view illustrating an experimental result related to heating duration in the following cases: a case where a rare-earth magnet is manufactured by use of a graphite container made of a graphite sheet; and a case where a rare-earth magnet is manufactured by applying, as lubricant, graphite particles or material particles other than the graphite particles to a molding die.
Figure 17:
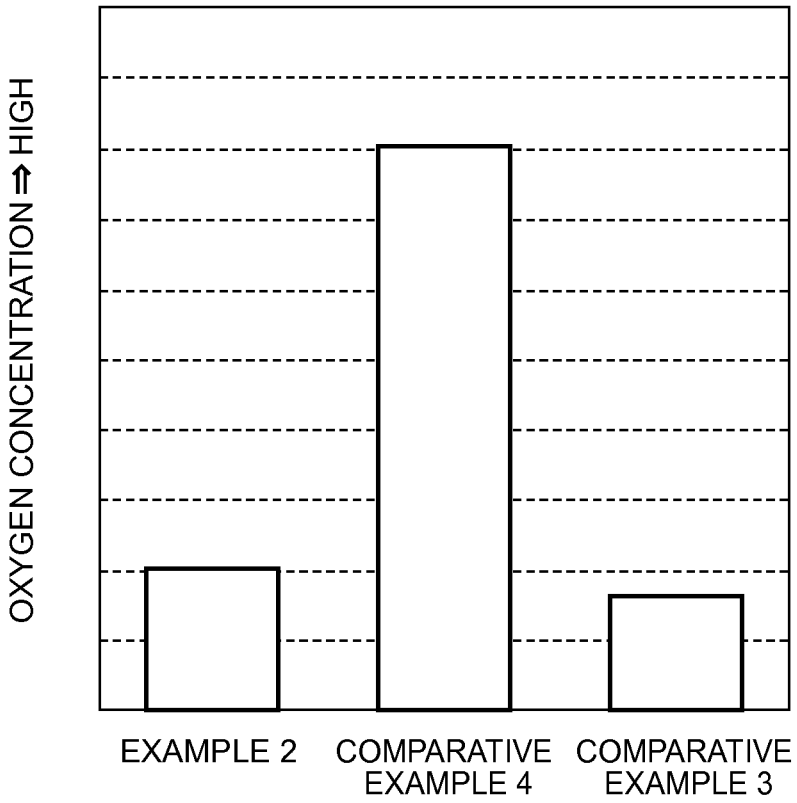
FIG. 17 is a view illustrating an experimental result related to an oxygen concentration inside a rare-earth magnet in the following cases: a case where the rare-earth magnet is manufactured by use of a graphite container made of a graphite sheet; and a case where the rare-earth magnet is manufactured by applying, as lubricant, graphite particles or material particles other than the graphite particles to a molding die.

FIG. 15 is a view illustrating an experimental result related to the usability and the high-temperature friction coefficient, FIG. 16 is a view illustrating an experimental result related to the heating duration, and FIG. 17 is a view illustrating an experimental result related to the oxygen concentration inside a rare-earth magnet.

According to FIG. 15, Example 2 had a low high-temperature friction coefficient and good usability. Further, in terms of Comparative Example 2, although a high-temperature friction coefficient was low, the glass lubricant was difficult to be removed because hardened glass was attached to an inner surface of the mold, a surface of the sintered body, and the like after the temperature decreased, so that usability of Comparative Example 2 was poor.

In the meantime, it was found from FIG. 16 that respective heating durations of Comparative Examples were 300 seconds, whereas a heating duration of Example 2 was around 10 seconds, which was relatively short.

Further, it was found from FIG. 17 that, although Example 2 was manufactured in the atmospheric air, its internal oxygen concentration was at the same level as Comparative Example 3 manufactured under the Ar-gas atmosphere. This is presumably because the graphite container prevented the magnetic powder from making contact with the atmospheric air, so that oxidation of the sintered body did not proceed.

The embodiment of the present invention has been described above, but the present invention is not limited to the embodiment. The embodiment may be modified appropriately in design without departing from the gist of the present invention.

What is claimed is:

1. A manufacturing method of a rare-earth magnet, comprising:

manufacturing a first sealing body by filling a first graphite container with a magnetic powder to be a rare-earth magnet material, then inserting an open end of the first graphite container into an open end of a second graphite container to form a third graphite container, and sealing the third graphite container, wherein the third graphite container is constituted by the first graphite container and the second graphite container;

manufacturing a sintered body by sintering the first sealing body to manufacture a second sealing body in which the sintered body is accommodated; and manufacturing a rare-earth magnet by performing hot plastic working on the second sealing body to give magnetic anisotropy to the sintered body, wherein an inside dimension of the second graphite container is larger than an inside dimension of the first graphite container, each of the first graphite container and the second graphite container is a tube-shaped body constituted by a deformed graphite sheet and having a rectangular section or a circular section, and the tube-shaped body has a closed end provided with a graphite base plate;

the method further comprising:

forming the tube-shaped body by deforming a graphite sheet along a side surface of a tube-shaped stand, the side surface having a rectangular section or a circular section, the tube-shaped stand including a bottom face provided on an end surface of the side surface, and the bottom face having a through-hole;

filling graphite powder into the tube-shaped stand by moving the tube-shaped stand relative to the tube-shaped body; and forming the base plate on an open end of the tube-shaped body by pushing the tube-shaped stand downward to perform press molding on the graphite powder after the graphite powder falls down below the bottom face of the tube-shaped stand through the through-hole.

2. The manufacturing method of a rare-earth magnet according to claim 1, further comprising manufacturing the graphite base plate by performing press molding on graphite powder filled into the tube-shaped body.

3. A manufacturing method of a rare-earth magnet, comprising:

manufacturing a first sealing body by filling a graphite container with a magnetic powder to be a rare-earth magnet material, disposing a graphite top plate on an open end of the graphite container, and sealing the graphite container;

manufacturing a sintered body by sintering the first sealing body to manufacture a second sealing body in which the sintered body is accommodated; and manufacturing a rare-earth magnet by performing hot plastic working on the second sealing body to give magnetic anisotropy to the sintered body;

wherein the graphite container is a tube-shaped body constituted by a deformed graphite sheet and having a rectangular section or a circular section, and the tube-shaped body has a closed end provided with a graphite base plate;

the method further comprising:

forming the tube-shaped body by deforming a graphite sheet along a side surface of a tube-shaped stand, the side surface having a rectangular section or a circular section, the tube-shaped stand including a bottom face provided on an end surface of the side surface, and the bottom face having a through-hole;

filling graphite powder into the tube-shaped stand by moving the tube-shaped stand relative to the tube-shaped body; and forming the base plate on an open end of the tube-shaped body by pushing the tube-shaped stand downward to perform press molding on the graphite powder after the graphite powder falls down below the bottom face of the tube-shaped stand through the through-hole.

4. The manufacturing method of a rare-earth magnet according to claim 3, further comprising manufacturing the graphite top plate by performing press molding on graphite powder.

* * * * *